US006234641B1

(12) United States Patent
Ungard

(10) Patent No.: US 6,234,641 B1
(45) Date of Patent: May 22, 2001

(54) ELECTROLUMINESCENT LAMP KIT

(76) Inventor: Kenneth R. Ungard, 266 Hanover Center Rd., P.O. Box 275, Hanover, NH (US) 03755

( * ) Notice: Subject to any disclaimer, the term of this patent is extended or adjusted under 35 U.S.C. 154(b) by 0 days.

(21) Appl. No.: 09/257,845

(22) Filed: Feb. 25, 1999

Related U.S. Application Data

(60) Provisional application No. 60/076,133, filed on Feb. 27, 1998.

(51) Int. Cl.[7] ..... F21L 15/14

(52) U.S. Cl. ..... 362/84; 362/812; 40/544

(58) Field of Search ..... 362/84, 812; 40/542, 40/544

(56) References Cited

U.S. PATENT DOCUMENTS

| | | | | |
|---|---|---|---|---|
| 2,566,349 | | 9/1951 | Mager . | |
| 2,858,632 | | 11/1958 | Caserio et al. . | |
| 4,181,925 | | 1/1980 | Burrows et al. . | |
| 4,297,681 | | 10/1981 | Dircksen . | |
| 4,443,832 | * | 4/1984 | Kanamori et al. | 362/84 |
| 4,559,582 | | 12/1985 | Scardilli et al. . | |
| 4,775,964 | | 10/1988 | Alessio et al. . | |
| 4,863,535 | * | 9/1989 | More | 156/54 |
| 4,864,473 | * | 9/1989 | Torkarz et al. | 362/84 |
| 5,257,167 | | 10/1993 | Clem . | |
| 5,265,071 | | 11/1993 | Thorgersen et al. . | |
| 5,268,827 | * | 12/1993 | Granneman et al. | 362/156 |
| 5,293,098 | * | 3/1994 | Brownell | 315/169.3 |
| 5,339,550 | * | 8/1994 | Hoffman | 362/84 |
| 5,346,718 | | 9/1994 | Thorgersen et al. . | |
| 5,559,680 | * | 9/1996 | Tabanera | 362/84 |
| 5,845,987 | * | 12/1998 | Painter | 362/206 |

* cited by examiner

*Primary Examiner*—Thomas M. Sember
(74) *Attorney, Agent, or Firm*—Devine, Millimet & Branch, P.A.; Paul C. Remus; Kristin Kohler

(57) ABSTRACT

A preferred embodiment of the invention includes a one-piece unit for retrofitting back-lit incandescent or compact fluorescent, LED, and EL signs with electroluminescent (EL) panels, or for fitting new signs with EL panels. The EL unit comprises an EL lamp attached to a diffuser, a connection module which may have built-in surge protection and which is connected to first and second electrical connection leads, or traces, of the EL lamp and heat wrapped in place by heat shrink tubing to ensure a stable connection, and at least two electrical connection lead wires extending from the connection module for attachment to one or more power sources. The connection module is selected based on the AC and/or DC voltage of the power supply in the location to be fitted or retrofitted. Another embodiment of the invention is a kit which may include the EL unit, wire nuts, adhesive mountings, and instruction sheets. The EL units of the present invention may also be used in new construction where there was never any signage, but where there are simply new back-lit signs required to be installed. A further embodiment is a method for making the one-piece EL unit and kit.

16 Claims, 7 Drawing Sheets

ELECTROLUMINESCENT LAMP KIT

PRIOR RELATED APPLICATIONS

The present application claims priority to prior U.S. Provisional Application Serial No. 60/076,133 filed Feb. 27, 1998.

BACKGROUND OF THE INVENTION

This invention relates to electroluminescent lamp technology as applied to retrofit existing back-lit signage or for installation as lighting for new signage. More particularly the invention relates to a unit or kit which allows for inexpensive and easy fitting of new signs, retrofitting and replacement of existing signs which are illuminated by conventional incandescent or compact fluorescent light bulbs, other electroluminescent (EL) lamps, and LED's, with electroluminescent light panels. Most particularly the invention relates to a pre-assembled electroluminescent (EL) light panel unit with an attached electrical connection module that is custom made and pre-assembled to a given specification such that installation time, cost, and error are substantially reduced.

The most critical feature of an emergency sign, for example an exit sign, is its visibility—in uniformity of illumination and contrast.

Another crucial aspect of emergency exit signs is their reliability. Lamp failure is a common problem in conventional fixtures.

Electroluminescent technology provides a more uniform illumination source than incandescent or fluorescent bulb lighting and lasts significantly longer, without other common problems associated with bulbs, such as hot spots that can eventually damage the sign, and dark spots that impair the visibility of the sign.

Electroluminescent technology itself has been known for many years. Some of its common uses are to illuminate the dials of instrument panels of automobiles and aircraft, and to illuminate the faces of wristwatches.

Recently this technology has been applied to replace the light source for signage such as EXIT signs which had traditionally been illuminated by one or more bulbs. The electroluminescent panels provide a more uniform light, and last much longer than bulbs, without other common problems of bulbs such as eventual distortion or removal of coloring on signs at areas nearest the bulbs due to the heat of the bulbs. An electroluminescent panel provides an extremely durable solid-state device which cannot bum out and which requires virtually no maintenance.

However, to date it has not been an easy task to retrofit or install electroluminescent lamp (EL) panels in signs. Each EL lamp panel typically has two electrical connection sites (leads or traces) which are connectable to a power source to provide the electrical field to illuminate the panel. Connections connecting the EL panel to the power source in a building must be made at the time of installation and are often physically difficult to make. The connections often break off, or otherwise become disconnected over time, resulting in installation error and failure of the retrofitted EL panel to light. In addition, there are various AC and DC voltages at which building electrical systems are supplied. Each EL panel must be appropriately connected such that in non-emergency systems the voltage across the EL panel is approximately 120V. Improperly adjusted voltage across the EL panel can result in installation error and possible failure of the EL retrofit panel.

It would be advantageous to have an inexpensive, easily installed retrofit kit or unit which can simply and easily be connected to the available power source, and which can also work with battery back-up systems in case of emergency or power failure.

SUMMARY OF THE INVENTION

A first embodiment of the invention is a one-piece unit usable for retrofitting back-lit signs with electroluminescent panels, comprising: an EL lamp secured and preferably laminated to a diffuser; a connection module, which may have built-in surge protection, connected to first and second electrical connection leads of the EL lamp and secured in place to ensure a stable connection; and at least two electrical connection lead wires extending from the connection module for attachment to one or more power sources. The connection module is selected based on the AC and/or DC voltage of the power supply or supplies in the location to be fitted or retrofitted.

Another embodiment includes a kit form containing the one-piece unit, adhesive means for connecting the EL unit to an existing sign frame, wire connectors and installation instructions. Other embodiments provide retrofit units having inverters for applications in which an emergency power source provides direct current (DC) to the emergency sign fixture. In such situations, the brightness of the letters and direction indicators is actually increased by 25% over brightness during normal use, thereby further enhancing its safety capabilities.

Accordingly, one aspect of the invention is to provide an electroluminescent unit which is inexpensive, easy to install and which significantly reduces installation error and subsequent failure of newly fitted or retrofitted signs.

Another aspect of the invention is to provide an electroluminescent unit that can withstand sudden shocks and vibrations, and that can even withstand multiple power surges of up to 6,000 volts.

A still further aspect of the invention is to provide an electroluminescent unit that requires no regular maintenance.

A further aspect of the invention is to provide an electroluminescent unit that delivers uniform, high-contrast illumination.

Another aspect of the present invention is to provide an electroluminescent unit that, unlike conventional red emergency exit signs, is calming, green, and will not be confused with a fire source in an emergency situation. The color scheme is also consistent with traffic signals, with green meaning go as opposed to red which has meant stop and danger.

It is a still further aspect of the invention to provide an electroluminescent unit that extends the life of the conventional emergency battery due to the minimal power requirements of the electroluminescent light panel.

It is a further aspect of the invention to provide an electroluminescent unit that meets or exceeds all code requirements for emergency exit sign retrofit kits.

A still further aspect of the invention is to provide an electroluminescent unit that, unlike compact fluorescent lamps which contain mercury, and incandescent bulbs which contain lead, contains no EPA-designated hazardous materials.

Another aspect of the invention is to provide an electroluminescent unit that operates on a fraction of a watt of power, and costs, on average, less than 60 cents per year to operate. No other electrically powered technology is more efficient.

Yet another aspect of the invention is to provide an electroluminescent unit that is inexpensive to produce and that can be made and assembled using standard equipment such as a paper cutter.

A further aspect of the invention is to provide an electroluminescent unit that is fully-integrated, with no bulbs to change and no parts to replace, and that also eliminates the related costs of bulb lighting including purchase, maintenance, installation and disposal costs, as well as other costs due to damage of wiring from excessive heat in the fixture (which can itself create hazardous situations), and the cost of cooling to offset the heat produced by conventional fixtures.

Still another aspect of the invention is to provide an electroluminescent kit that contains a one-piece electroluminescent unit, adhesive materials for attaching the unit to a sign, wire connectors and installation instructions such that installation is easy, rapid, and significantly reduces associated installation error and failure of the unit.

These and other aspects of the invention are described in greater detail below.

DETAILED DESCRIPTION OF THE INVENTION

Figure 1:
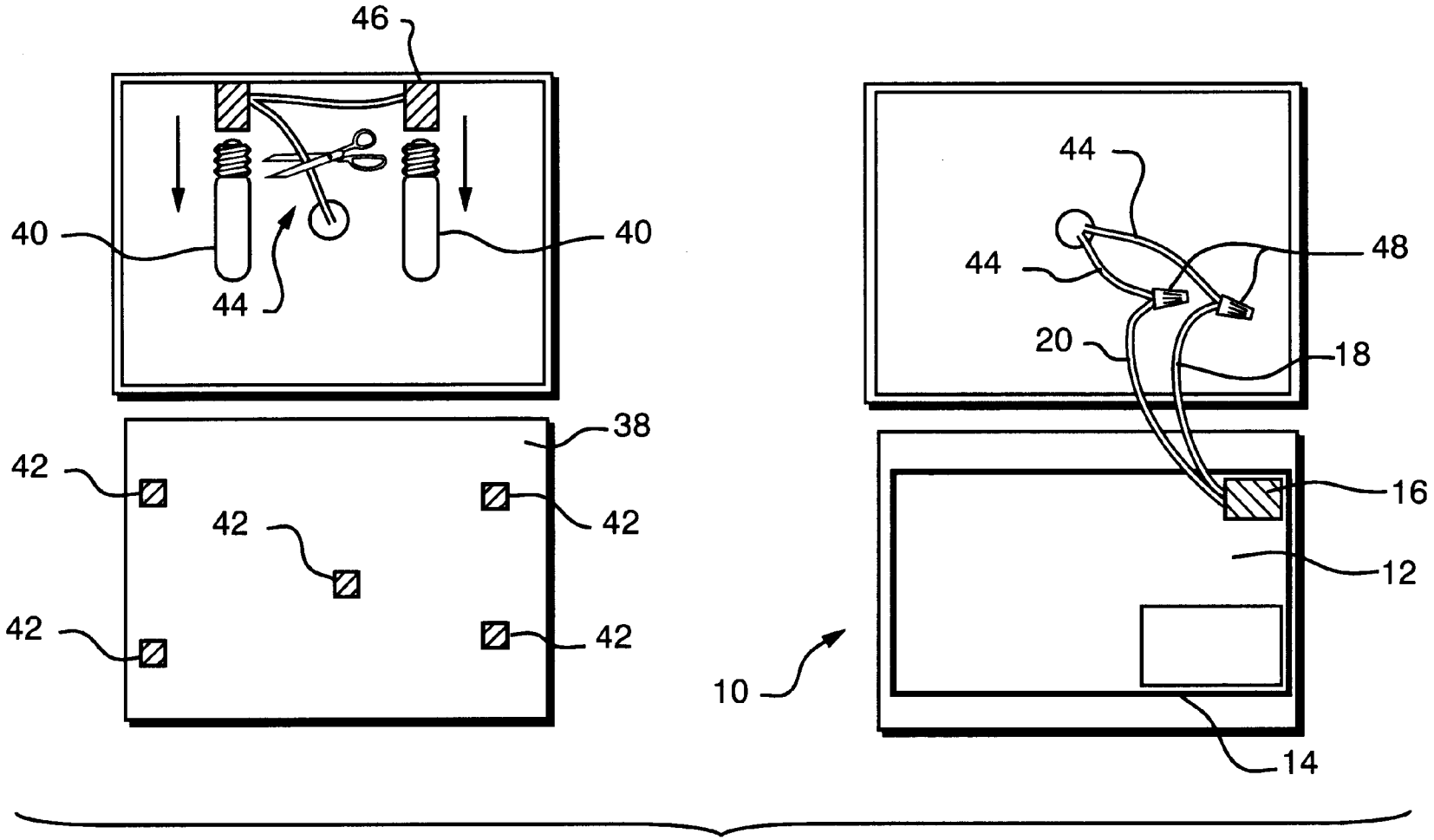
FIG. 1 is a schematic representation of the installation steps required to install a 120VAC unit.
Figure 2:
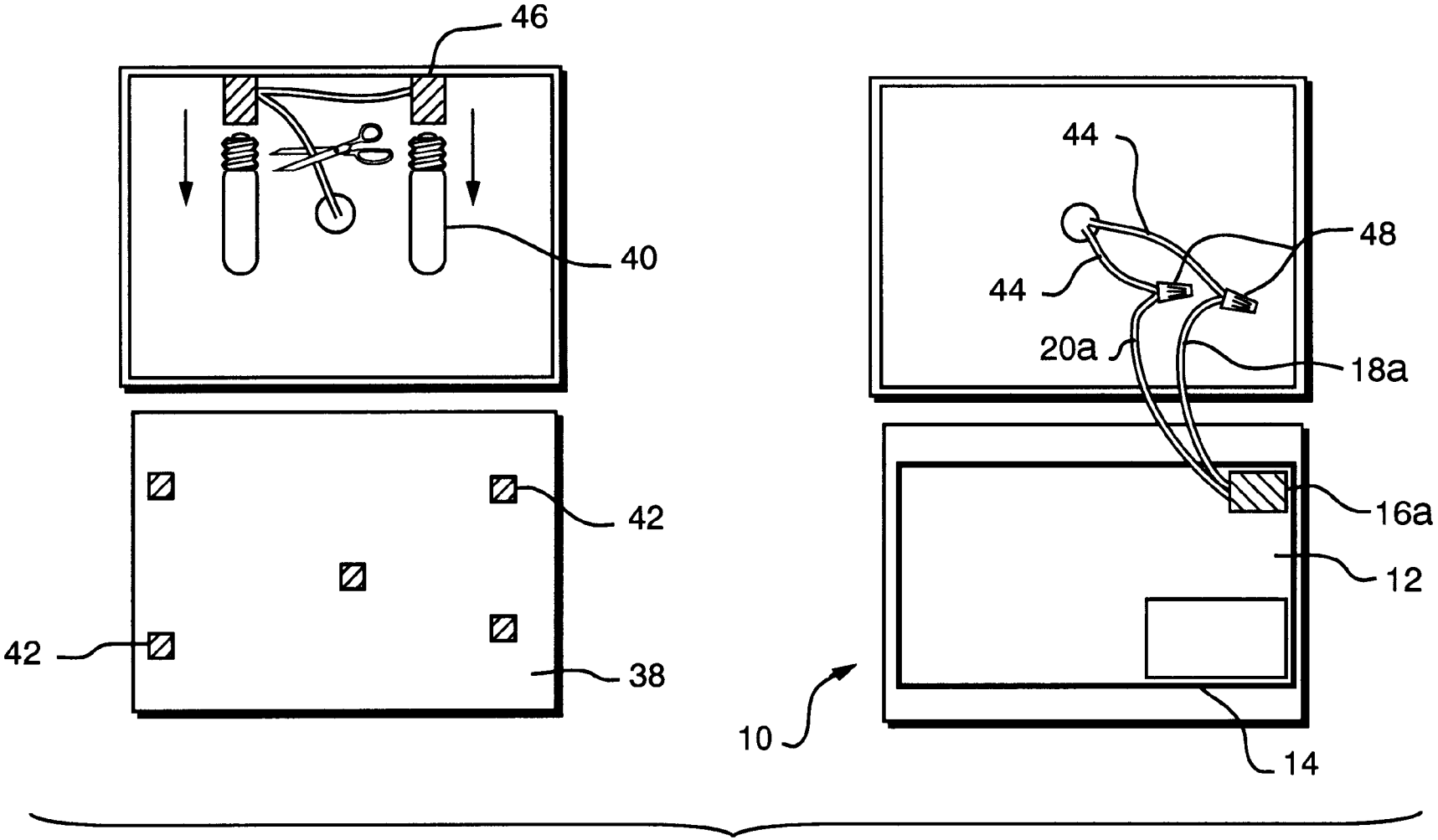
FIG. 2 is a schematic representation of the installation steps required to install a 277VAC unit.
Figure 3:
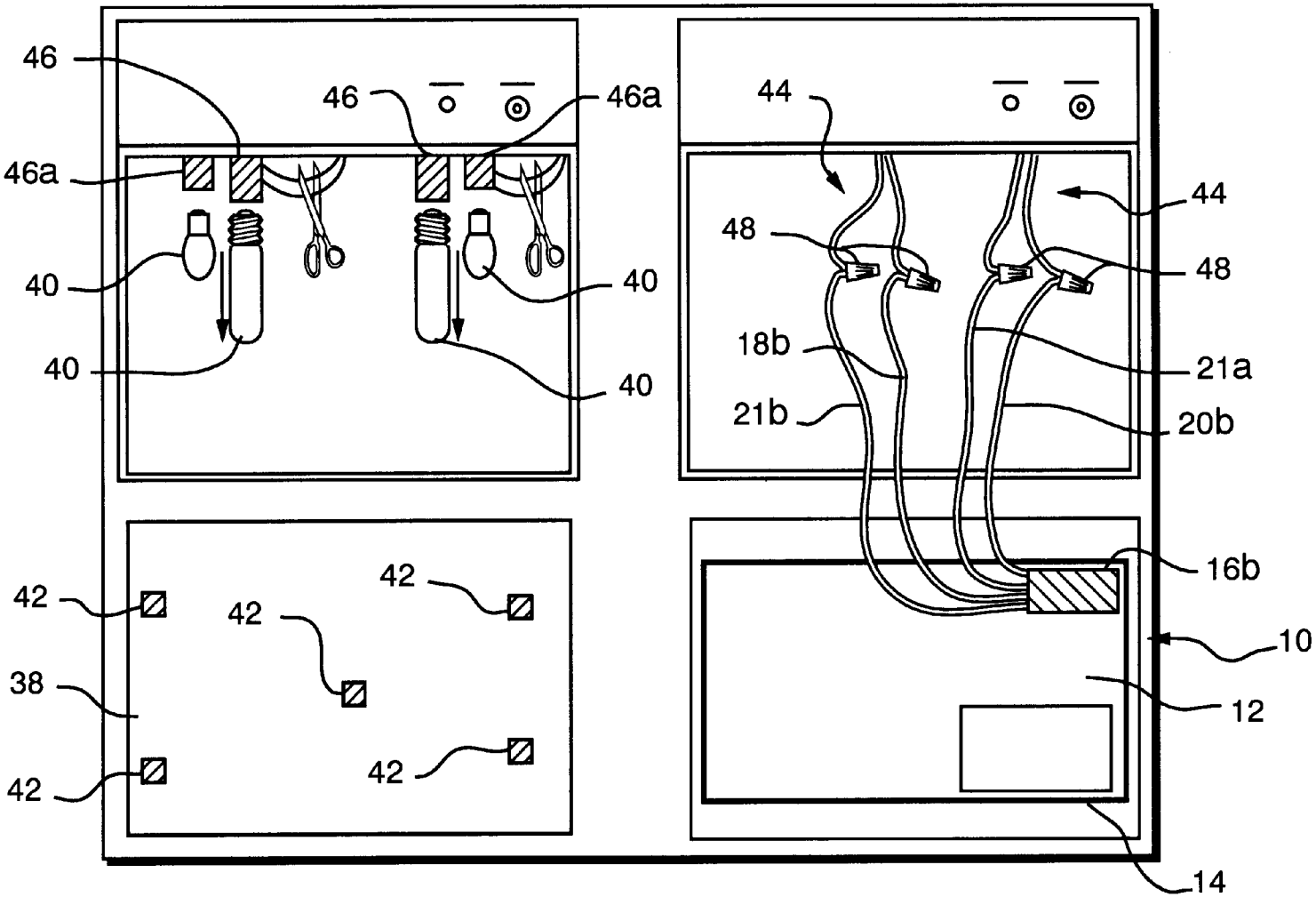
FIG. 3 is a schematic representation of the installation steps required to install a 120VAC with 6VDC or 12VDC battery back-up units.
Figure 4A:
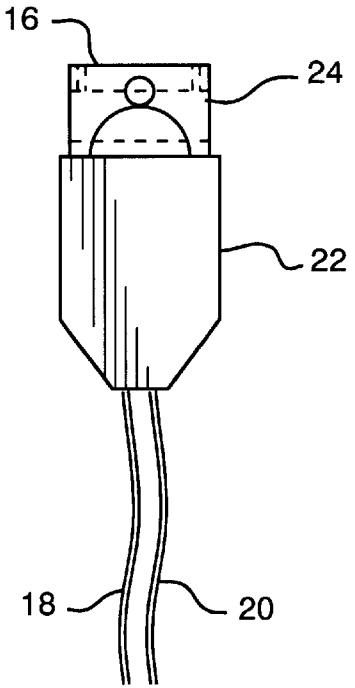
FIGS. 4*a–d* show the connection module for a 120VAC unit.
Figure 4B:
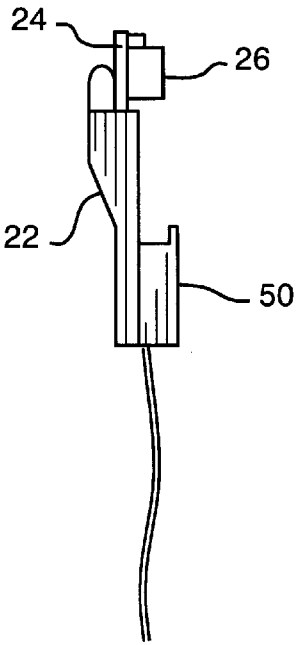
Figure 4C:
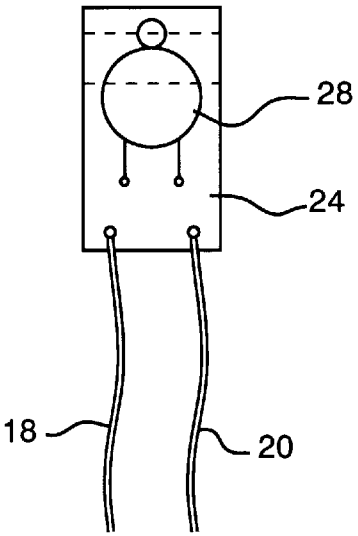
Figure 4D:
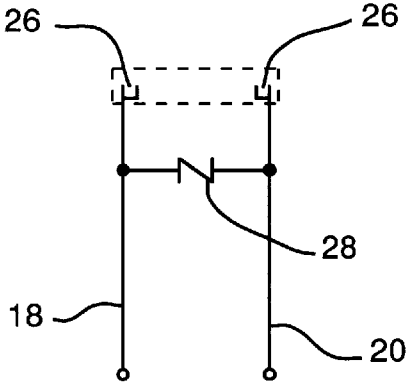
Figure 5D:
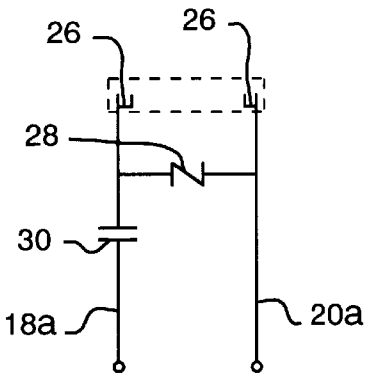
FIGS. 5*a–d* show the connection module for a 277VAC unit.
Figure 5C:
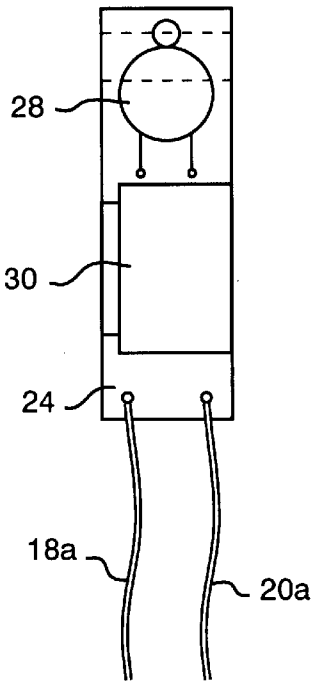
Figure 5B:
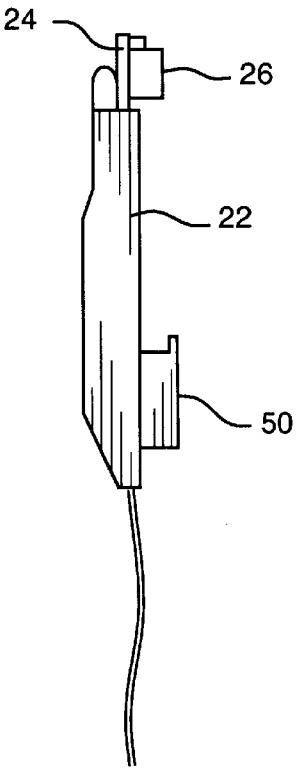
Figure 5A:
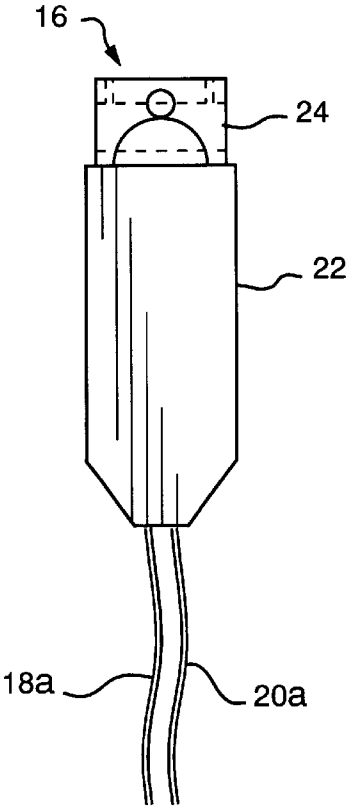
Figure 6C:
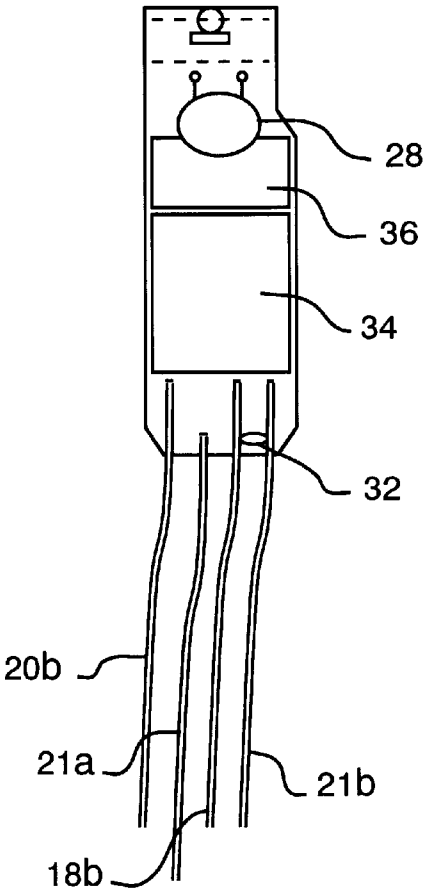
FIGS. 6*a–c* show the connection module for a 120V AC and 6V or 12 V DC battery back-up unit.
Figure 6B:
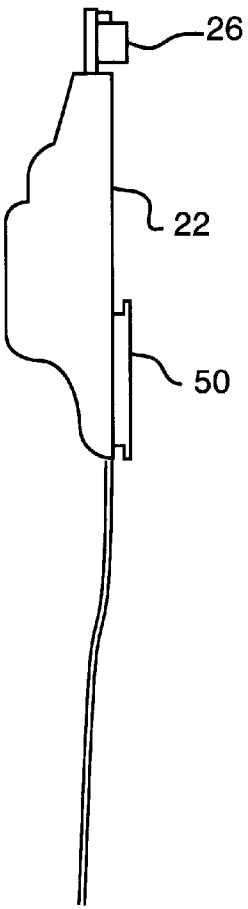
Figure 6A:
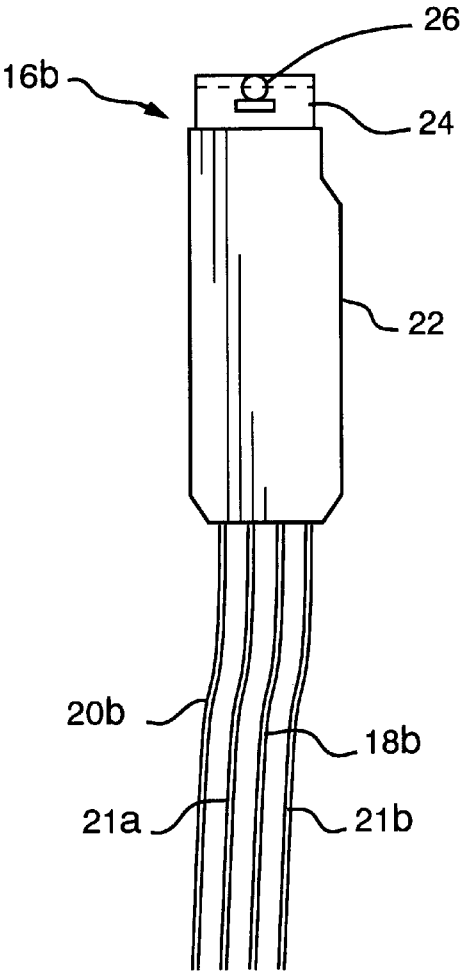

Referring now to the Figures in which like reference numerals refer to like elements, a preferred embodiment of the invention includes a pre-assembled one-piece unit 10 usable for retrofitting back-lit signs with electroluminescent lamps or for fitting new signage with electroluminescent lighting. The unit, as seen in FIGS. 1–3, comprises an electroluminescent (EL) lamp 12, secured, preferably by lamination, to a diffuser 14, a connection module 16–16*b* with built-in surge protection connected to first and second electrical contacts or connection leads (not shown) of EL lamp 12 and heat wrapped in place by thermally activated adhesive lined heat shrink tubing 22, to ensure a stable connection, at least one adhesive pad member 50 to help make connection module 16, 16*a* or 16*b* level to further ensure a stable connection, and at least two electrical connection lead wires 18, 18*a* or 18*b*, and 20, 20*a* or 20*b* extending from the connection module for attachment to one or more power sources. The connection module 16 is selected based on the AC and/or DC voltage of the power supply in the location to be fitted or retrofitted. Another embodiment of the invention is a kit which may include the EL 12 and connector module 16, 16*a* or 16*b*, wire nuts or connectors 48, adhesive mountings 42, and instruction sheets (not shown).

The connection module 16 preferably uses either Zero Insertion Force (ZIF) or Low Insertion Force (LIF) connectors known in the electrical arts. Until now, spring contacts, crimp, or solder connections were used to make contact with the two contacts on an EL lamp panel to power the EL panel. The contacts on the EL lamp panel of the present invention are preferably screen printed on to the EL panel, and the ZIF and LIF connectors provide good contact to the EL panel's electrical contacts.

In order to retrofit an existing building with the EL retrofit unit of the present invention the location is surveyed to determine: the voltage supply of the building, the size and quantity of EL retrofit units 10 needed, whether the signs are single or double sided, and whether or not the system has a battery back-up. Various common voltages include 120V, 277V, and 6 or 12 VDC battery back-up. EL lamp panels 12 may be formed in about ¼ inch increments from about 9 to about 13 inches in length, but can be made in about ⅛ inch increments from about 6 to about 13 inches in length. The EL lamp panels are preferably an illuminated height of 6.2 inches, as U.S. exit signs are required to have 6 inch high letters. Once the voltage and size requirements, are known, the EL lamps 12, and diffusers 14 are cut, if needed, to the correct size increments, the appropriate connector module 16, 16*a* or 16*b* is attached to obtain the appropriate voltage across the EL lamp 12. There are currently three preferable connection modules 16, 16*a*, or 16*b* corresponding to the common voltages and back-up systems.

The module 16 for a 120V power supply, as shown in FIGS. 1 and 4*a–d*, includes:

- a circuit board 24 (preferably, by way of non-limiting example, a UL recognized copper clad two sided circuit board approximately 0.80 inches×1.30 inches in size) with the ZIF or LIF connectors 26 thereon, a varistor, preferably an MOV (Metal Oxide Varistsor) 28 for surge protection, for example a Panasonic ERZ-V14D2221 or similar MOV, and electrical connection lead wires 18 and 20. Wire 18 is commonly a black 120VAC input wire, and 20 is a white neutral wire. For the 120V kit, input wattage should be less than about 0.65 W, and input voltage about 120V at 60 Hz.

The module 16*a* for a 277V power supply, as shown in FIGS. 2 and 5*a–d*, includes:

- a circuit board 24 (approximately 0.80 inches×2.40 inches in size) with appropriate ZIF or LIF connectors 26 , a varistor 28 (for example a Panasonic ERZ-V14D221 or similar), a capacitor 30 (for example a Roederstein F1772-422-2030, 0.22 microfarad, 275VAC or similar) in series with the EL lamp panel, and electrical connection lead wires. Wire 18*a* is commonly a brown 277VAC input wire, and wire 20*a* a white neutral wire. For 277V power supply, the input wattage should be less than about 0.65 W, and the voltage about 277V at 60 Hz. The proper capacitor value is determined by the capacitance of the EL lamp panel in order to regulate and attain the desired voltage across the EL lamp panel. The EL lamp panel 12 itself acts like a leaky capacitor. Thus, a capacitor in series with the EL lamp panel is like having two capacitors in series and serves to reduce the 277V power supply to about 120V across the EL lamp panel.

For systems with a battery back-up there is connection module 16*b* (which may be used with either a 6VDC or 12VDC battery back-up), as shown in FIGS. 3 and 6*a–c* for a 120VAC power supply with battery back-up, including a circuit board 24 (approximately 0.90 inches×2.90 inches) with connectors 26, a first varistor 28 (as above), an additional varistor 32 (for example a Panasonic EZR-V05D220 or similar) across the DC input, and electrical connection lead wires. Wire 18*b* is commonly a black 120VAC input wire, 20*b* a white neutral wire, 21*a* a red positive DC input wire and 21*b* a black negative DC wire. The AC input wattage should be less than about 0.65 W, and AC input voltage about 120V, 60 HZ. The DC input wattage should be less than about 2 W, and DC input voltage about 6 or 12V nominal. Most of the time the second varistor 32 would not be needed but, potentially in retrofitting, very old signs would need additional surge protection from the DC source to prevent surges from getting to the EL lamp panel 12. To switch from an AC to DC feed, there is preferably a relay 36 (for example a Magnacraft & Struthers-Dunn relay) that connects to an AC inverter 34 which is used to take 6 or 12V DC input from the battery to produce approximately 70V at about 500 Hz to power the EL lamp panel 12. The AC inverter 34 output is fed to the EL lamp panel 12.

Sign systems that do not have battery back-up are usually operated by an emergency generator which delivers the same voltage and frequency as the regular power source, so there is no change in brightness for non-battery back-up systems when emergency power is used. However, with the present invention, there is also a mechanism included in an embodiment to be used with signs that do have battery back-up such that in an emergency, when the battery back-up is required, the brightness of the EL lamp is increased by 20–30% when powered from the back up battery.

The EL retrofit unit 10 of the present invention can compete with "off the shelf" type products because the diffuser 14 and the connection and power conversion module 16 (16*a* or 16*b* also) are preferably attached to the EL lamp panel 12 before delivery. Thus pre-delivery assembly of the one-piece EL retrofit unit 10 is quick and relatively simple once the specifications of size and voltage are known. The product may then also be shipped as a kit including the pre-assembled EL retrofit unit 10 with connection module 16, 16*a* or 16*b* and diffuser 14 already securely attached to EL lamp panel 12.

All that is necessary with the kit at installation is connecting the two wires (or four for battery back-up systems) from the connection module to the power supply wires. This reduces installation time, the connection made is more reliable, and the module can be removed and either the module or EL unit 10 reused. This was not possible previously. In previous retrofitting, the power supply wires would be directly connected to the connections on the EL lamp panel, by soldering or similar method, and were quite susceptible to stress. The wires would often break or the connections would come apart. If this happened, in most cases the EL lamp panel could not be reused, even if the EL panel itself were not defective. The EL lamp panel was therefore often unfit to use because the connections of the EL lamp panel would be damaged.

In the present invention, a heat shrinkable covering 22 (UL approved) is applied over the connected module 16, 16*a* or 16*b* to take strain off the connections between the EL lamp panel 12 and the module 16, 16*a* or 16*b*), and to insulate the connection from outside stresses. Past EL retrofit connections required much more effort at installation, and often sooner or later, too often sooner, failed.

In the past, in addition to the connection of the power supply being made on the EL lamp itself, an appropriately colored diffuser and EL lamp panel had to be separately installed in, for example, an exit sign fixture at the time of retrofitting. There was also previously a limited amount of sizes of panels and types of devices to be used to make the electrical connection to the EL lamp panel. In the past there also was none known to have built in surge protection and such surge protection would need to be added separately or would not be present in EL retrofitted signage.

In the case of the present invention, the diffuser 14 is preferably pre-laminated to the EL lamp panel 12, and the connection module (including surge protection) 16, 16*a* or 16*b* may be pre-attached and heat wrapped once connected onto the connectors of the EL lamp panel 12. Thus, the connection module 16, 16*a* or 16*b*, with the appropriate connectors, surge protection and electrical connection lead wires may be pre-attached to the EL lamp panel 12, and the diffuser 14 is pre-affixed such that the entire assembly comes as one-piece EL unit 10 and simply has to be connected to the power supply using the appropriate wires extending from the connection module. If the connection module needs to be replaced it can be removed and the EL lamp panel 12 with attached diffuser 14 reused. The EL retrofit units 10 of the present invention may also be used in new construction where there are simply new signs required to be installed.

A further embodiment is a method for making a one-piece EL unit and kit. The preferable example processing steps involved to make an embodiment of the electroluminescent unit are:

1—Cut an EL lamp 12 to length with a paper cutter—approximately 50 pieces may be stacked and cut at a time.

2—Apply low tack removable adhesive protective tape tabs over the printed front and back electrical contacts, conductor traces or leads. The tape prevents the adhesion of the heat activated PET (polyester) laminating film to the contacts.

3—Using a heated film laminator, and custom lamp feed fixture, laminate the EL lamps 12 between PET heat activated adhesive film fed from rolls. Two lamps are preferably fed at one time allowing a small space between the sides and ends. The sides are precision slit upon exit from the laminating rolls, creating one of two registration edges needed for accurate steel rule die cutting.

4—Registration cut the lead end of the laminated lamp on a paper cutter using visual alignment and a side straight edge. The registration cut EL lamps 12 are then die cut to the final laminated lamp configuration.

5—Cut off diffusers 14 to the same finished width as the laminated EL lamp 12. The preferably fluorescent green (but may be any requested color) diffusers 14 are typically supplied in widths of 11" and 13" with clear pressure sensitive adhesive applied to the screen-printed side.

6—Laminate the die cut lamp to the diffuser 14, and using edge alignment fixture, position EL lamp 12 on a diffuser 14 that has a short length of its release liner peeled back to expose an adhesive edge. Then feed both through the laminator nip (with heat turned off) while peeling off the release liner. This method eliminates the possibility of air entrapment between the EL lamp 12 and the diffuser 14 and produces a perfectly aligned assembly.

7—Remove the removable tape from the EL electrical contacts, and lift the backside PET laminate at the electrical contacts of the EL lamp 12 where the removable tape was placed to prevent the heat activated laminate from sticking to the leads. The lead contact points of the electrical contacts are therefore exposed undamaged and ready to accept connection module attachment.

8—Apply connection module 16, 16*a* or 16*b* to EL lamp 12. The appropriate module is selected and applied to the EL lamp and diffuser assembly. One of preferably four modules is selected: 120VAC, 277VAC, 120VAC/6VDC, or 120VAC/12 VDC.

9—Apply adhesive lined heat shrink tubing over the connection module and EL lamp 12 tail where the electrical contacts are located.

10—Apply heat to heat shrink tubing with a protective shield in place, using a heat gun. The tubing shrinks to its recovered size and the adhesive liner softens and forms a bond with the lamp tail and connection module.

11—Remove release liners from the connection module 16, 16*a* or 16*b*, and diffuser 14 corner. The connection module is secured with the pressure sensitive contact between the connection module and the EL lamp 12.

12—Test turn-on each finished electroluminescent panel unit and QC inspect, 100% of the batch.

13—Apply label

14—Bag completed EL unit or kit. The completed, tested unit is then placed in a plastic bag along with adhesive pads used to mount the unit in an existing exit sign being retrofitted. Wire connectors, such as wire nuts, and installation instructions may be included. The retrofit kit embodiment contains all components needed to easily and properly install the EL lamp unit 10. Installation in double-sided signs requires two retrofit kits.

For example, to retrofit a 120VAC bulb-lit EXIT sign: remove EXIT fixture front cover 38, and bulbs 40, disconnect the power at the source, remove existing diffuser lens and discard, apply double side foam adhesive pads 42 preferably to the four corner positions around the stenciled EXIT letters and preferably between the "X" and "I" on the inside surface of the front cover, remove release paper from adhesive pads and position the EL unit 10 to cover all letters and chevrons or arrows, press firmly in place, cut electric supply wires 44 as close to existing bulb sockets 46 as permitted and remove sockets 46, if possible, use Insulation Displacement Connectors (IDC) 48 or wire nuts to connect existing socket supply wires 44 to the EL retrofit unit electrical connection lead wires 18 and 20. Double sided signs require two retrofit kits connected in parallel to one source. Finally, replace and secure EXIT fixture stencil cover(s) and confirm proper operation. For the 120V kit, input wattage should be less than about 0.65 W, and input voltage about 120V at 60 Hz. For 277V power supply, the input wattage should be less than about 0.65 W, and the voltage about 277V at 60 Hz. Otherwise installation instructions are the same as those for a 120VAC power source.

For a 120V AC/12V DC emergency system retrofit kit, there must be multiple power supplies, AC and DC. This particular kit is not intended for fixtures originally supplied with fluorescent lighting. The AC input wattage should be less than 0.65 W, and AC input voltage 120V, 60 HZ. The DC input wattage should be less than 2 W, and DC input voltage 12 V nominal. In this kit, there will be four electrical connection lead wires 18*b*, 20*b*, 21*a* and 21*b* coming from the connection module 16*b*, two for connection to the AC and two for connection to the DC power supply. The black wire 18*b* is for the 120VAC input, the white wire 20*b* is neutral, and the red and black wires 21*a* and 21*b* respectively are for the positive and negative DC connections respectively. There will also be four bulbs 40 to be removed from the EXIT sign, as shown in FIG. 3, two from the AC and two from the DC supply in sockets 46 and 46*a* respectively. The two AC powered bulb sockets are wired in parallel as are the two DC powered sockets.

For a 120VAC/6VDC emergency retrofit kit, input wattage for AC should be less than about 0.65 W, AC input voltage about 120V, 60 Hz. DC input wattage should be less than about 1.6 W and DC input voltage about 6V nominal. Otherwise installation is the same as that for the 120VAC/12VDC retrofit kit.

Preferred example part numbers and specifications, for example in the connector modules 16, 16*a* and 16*b*, are shown in the drawings and drawing legends. Descriptions in the legends of the drawings are incorporated herein as part of the disclosure of this invention, as examples of preferred components for the capacitors, varistors, inverter, relay, and connectors etc.

Figure 7:
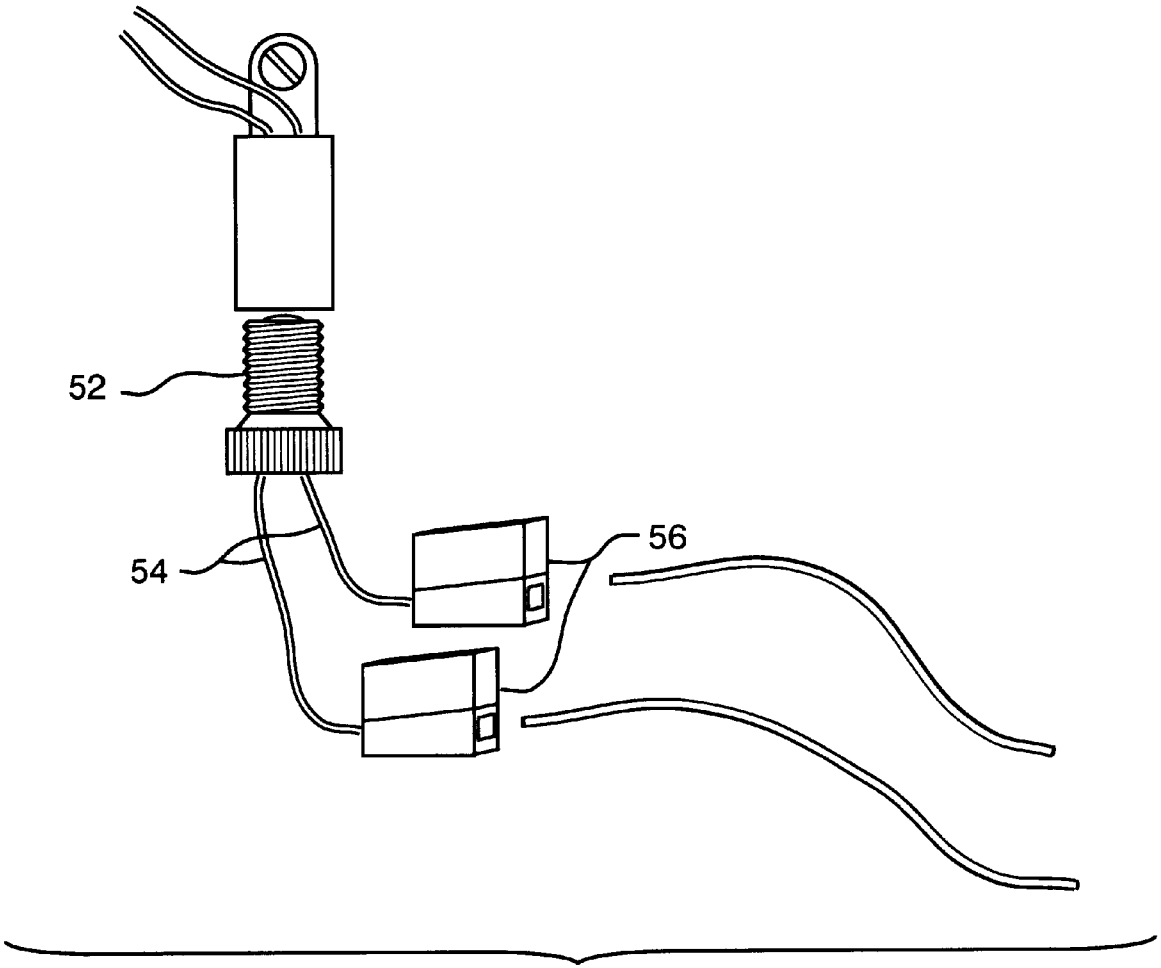
FIG. 7 shows the optional retrofit adapter for use with incandescent exit signs, the adapter having spring connectors for easily connecting the power source wires to the connection module wires. Such a connector may be used with any of the retrofit units.

There may also be included a retrofit adapter 52, as shown in FIG. 7, for incandescent exit signs, which saves installation time in connecting the wires from the module 16, 16*a* or 16*b* to the power supply wires. The adapter 52 may screw into the incandescent socket, and has two wires 54 extending therefrom. On the end of each wire 54 there may be a spring connector 56 into which is inserted the stripped end of one of the connection module wires, either 18, 18*a*, 18*b*, 20, 20*a*, 20*b*, 21*a* or 21*b* from the module 16, 16*a* or 16*b*. The spring connector 56 is held open, the wire end inserted, and then the spring connector is released, securing the wire in the spring connector.

Although the present invention has been described with the above-identified preferred embodiments, workers skilled in the art will recognize that changes may be made in form and detail of structure and operation without departing from the spirit and scope of the invention.

Accordingly, what is claimed is:

1. An Electroluminescent Lamp unit for fitting signage with electroluminescent lighting comprising:

an electroluminescent lamp secured to a diffuser, a connection module connected to first and second electrical contacts of said electroluminescent lamp and secured in place to ensure a stable connection, at least two electrical connection lead wires connected to and extending from said connection module for attachment to at least one power source, and wherein said connection module is held in place on said electroluminescent lamp by heat shrink tubing wrapped around said connection module and said first and second electrical contacts of said electroluminescent lamp.

2. The electroluminescent lamp unit according to claim 1 wherein said stable connection is further reinforced by at least one adhesive pad member placed between said connection module and said electroluminescent lamp to level said connection module.

3. The electroluminescent lamp unit according to claim 1 wherein said connection module is adaptable for 120 VAC and 277 VAC main power supplies, and for 6 VDC and 12 VDC battery back up power supplies.

4. The electroluminescent lamp unit according to claim 3 wherein said connection module for a 120 VAC power supply comprises:

a circuit board having a plurality of connectors thereon;

a varistor for surge protection; and said at least two electrical connection lead wires.

5. The electroluminescent lamp unit of claim 4 wherein said plurality of connectors are chosen from the group consisting of zero insertion force and low insertion force connectors.

6. The electroluminescent lamp unit of claim 4 wherein said varistor is a metal oxide varistor.

7. The electroluminescent lamp unit according to claim 3 wherein said connection module for a 277 VAC power supply comprises:

a circuit board having a plurality connectors thereon;

a varistor;

a capacitor in series with said electroluminescent lamp; and said at least two electrical connection lead wires.

8. The electroluminescent lamp unit according to claim 7 wherein said plurality of connectors is chosen from the group consisting of zero insertion force and low insertion force connectors.

9. The electroluminescent lamp unit according to claim 7 wherein said varistor is a metal oxide varistor.

10. The electroluminescent lamp unit according to claim 3 wherein said connection module for a 120 VAC main power supply with a DC battery back up power supply comprises:

a circuit board having a plurality of connectors thereon;

a first varistor;

an additional varistor across a DC input for said battery back up power supply; and at least four electrical connection lead wires, at least two for connection to an AC main power supply, and at least two for connection to said DC battery back up power supply.

11. The electroluminescent lamp unit according to claim 10 wherein said plurality of connectors is chosen from the group consisting of zero insertion force and low insertion force connectors.

12. The electroluminescent lamp unit according to claim 10 wherein said first varistor and said additional varistor are metal oxide varistors.

13. The electroluminescent lamp unit according to claim 1 wherein said connection module is removable such that said electroluminescent lamp and said connection module are reusable.

14. A kit for fitting back-lit signage with and Electroluminescent Lamp unit comprising:

a one-piece electroluminescent lamp unit comprising an electroluminescent lamp secured to a diffluser;

a connection module connected to first and second electrical contacts on said electroluminescent lamp by heat shrink tubing wrapped around said connection module and said first and second electrical contacts of said electroluminescent lamp; and at least two electrical connection lead wires connected to and extending from said connection module for attachment to at least one power source;

at least two wire connectors or nuts;

a plurality of adhesive members to secure said one-piece electroluminescent lamp unit to a sign case; and instruction sheets for installation of said one-piece electroluminescent lamp unit.

15. A method for making a one-piece electroluminescent lamp unit comprising the steps of:

cutting an electroluminescent lamp panel to a predetermined length with a paper cutter;

applying low tack removable adhesive protective tape over printed front and back electrical contacts of said electroluminescent lamp panel to prevent the adhesion of heat activated polyester laminating film to said electrical contacts;

using a heated film laminator, and custom lamp feed fixture, laminating each said electroluminescent lamp panel between polyester heat activated adhesive film fed from rolls, wherein two electroluminescent lamp panels are feedable at one time, thereby allowing a small space between sides and ends of each said electroluminescent lamp panel;

precision slitting each said side upon exit from the laminating rolls, creating one of two registration edges needed for accurate steel rule die cutting;

registration cutting a lead end of each now laminated electroluminescent lamp panel on a paper cutter using visual alignment and a side straight edge;

die cutting each now registration cut electroluminescent lamp panel to a final laminated electroluminescent lamp panel configuration;

cutting off an appropriate diffuser to the same finished width as said laminated electroluminescent lamp panel;

laminating said laminated electroluminescent lamp panel to said diffuser, and positioning said electroluminescent lamp panel on said diffuser, said diffuser having a short length of diffuser release liner peeled back to expose an adhesive edge;

feeding both said electroluminescent panel and said diffuser, now laminated together, through a laminator nip with heat turned off while peeling off said release liner, thereby producing a perfectly aligned assembly;

removing said tape, and lifting the backside polyester laminate at said printed front and back electrical contacts of said electroluminescent lamp panel where said removable tape was placed to prevent heat activated laminate from sticking to said electrical contacts, thereby exposing said electrical contacts undamaged and ready to accept module attachment;

applying an appropriate connection module to said electroluminescent lamp panel;

applying adhesive lined heat shrink tubing over said connection module and said electrical contacts of said electroluminescent lamp panel;

applying heat to said heat shrink tubing with a protective shield in place, such that said tubing shrinks and said adhesive liner softens and forms a bond with said electroluminescent lamp panel and said connection module;

removing said release liners from said connection module and said diffuser such that said connection module is secured with a pressure sensitive contact between said connection module and said electroluminescent lamp panel, thereby forming a one-piece electroluminescent lamp unit ready for installation or retrofitting of signage.

16. The electroluminescent lamp unit according to claim 1 wherein at least one stabilizing pad is attached to said connector module to level and stabilize said connection module.

* * * * *